US005660281A

United States Patent [19]

James

[11] Patent Number: 5,660,281

[45] Date of Patent: Aug. 26, 1997

[54] DEVICE FOR CANDLE STORAGE

[75] Inventor: Barry A. James, Englewood, Colo.

[73] Assignee: James Associates (U.S.A.), Ltd., Englewood, Colo.

[21] Appl. No.: 551,817

[22] Filed: Nov. 7, 1995

[51] Int. Cl.[6] ..... B65D 1/36; C11C 5/02; F23D 3/24

[52] U.S. Cl. ..... 206/563; 206/443; 249/120; 249/130; 425/803; 431/292; 431/295

[58] Field of Search ..... 431/288, 292, 431/295, 291, 294, 289, 297; 425/117, 803; 249/119, 120, 126, 130; 206/562–564, 443; 220/507; 362/161

[56] References Cited

U.S. PATENT DOCUMENTS

| | | | |
|---|---|---|---|
| 692,109 | 1/1902 | Boniface | 220/507 X |
| 747,780 | 12/1903 | Schimpf | 431/295 |
| 1,570,133 | 1/1926 | Di Bella | 431/292 |
| 1,647,898 | 11/1927 | Bearse | 431/297 |
| 1,935,831 | 11/1933 | Cunningham | 431/295 X |
| 2,137,701 | 11/1938 | Replogle | 431/291 |
| 2,218,901 | 10/1940 | Addis et al. | 206/443 |
| 2,255,546 | 9/1941 | Hansen | 249/126 |
| 2,322,519 | 6/1943 | Ingebrigtsen | 206/562 |
| 2,527,707 | 10/1950 | Curtis | 431/297 |
| 2,689,470 | 9/1954 | Turner | 431/297 |
| 3,124,247 | 3/1964 | Churchill | 206/443 |
| 3,272,371 | 9/1966 | Weiner | 206/443 X |
| 3,589,511 | 6/1971 | Britt | 206/564 X |
| 3,721,419 | 3/1973 | Bolinger | 249/120 X |
| 3,741,711 | 6/1973 | Bryant | 431/288 X |
| 3,797,990 | 3/1974 | Rogers et al. | 431/288 X |
| 3,905,506 | 9/1975 | Florian | 206/564 X |
| 3,932,113 | 1/1976 | Thrush | 431/297 |
| 4,560,535 | 12/1985 | Bouchee | 206/563 X |
| 5,121,835 | 6/1992 | Grupe | 425/803 X |
| 5,197,626 | 3/1993 | Bernstein | 220/507 |

FOREIGN PATENT DOCUMENTS

| | | | |
|---|---|---|---|
| 205507 | 1/1924 | United Kingdom | 431/292 |

*Primary Examiner*—Bryon P. Gehman

*Attorney, Agent, or Firm*—Davis, Graham & Stubbs, LLP

[57] ABSTRACT

Wax candles are stored and transported in containers shaped similarly to the candles. The ambient temperature may cause the candles to partially or completely melt and hence lose their shape. When the ambient temperature eventually lowers, the candles will resolidify in the containers in their initial shape, and thus spoilage is prevented. A plurality of containers may be connected to form a candle storage tray, and several trays may be stacked atop one another in a storage container such as a basket.

2 Claims, 2 Drawing Sheets

DEVICE FOR CANDLE STORAGE

FIELD OF THE INVENTION

The present invention relates to the field of wax candles, and more particularly to a device and method for storing and transporting candles to reduce spoilage related to candle deformation.

BACKGROUND OF THE INVENTION

Candles have been used to generate light and heat from ancient times to the present. While electric lights have to a large extent replaced candles for utilitarian lighting purposes, candles still are used for many specialized purposes. Candles are used when electricity is unavailable, such as during power outages, and for camping, where the heat generating quality of candles may be particularly useful. Even when electricity is available, candles are still used for their decorative effect. For instance, candles are often used for supplemental table-side lighting in homes and restaurants. Candles are also used extensively in many religious ceremonies and for other religious purposes, sometimes in large quantities and for prolonged periods of time, with different types of candles associated with different religious ceremonies.

"Taper" candles are truncated cones, with a length that is substantially greater than their maximum diameter, so that there is a gradual taper from the base of the candle to the wick end of the candle. This results in a lower center of gravity than would exist without the taper, which increases the stability of the candle. Taper candles are widely used for decorative and religious purposes. "Votive" candles are primarily cylindrical in shape, with a length that is much closer to the diameter of the candle than is the case for taper candles. As their name suggests, votive candles are often used-in religious ceremonies and for religious fund raising. Like taper candles, votive candles are also widely used for their decorative effect.

The basic operation of candles is well known: a wick extends through combustible wax such as paraffin that comprises the body of the candle, and lighting the wick maintains a flame that gradually melts and consumes the candle wax. Different wax compositions are used to created candles with different burning rates. The candle making process is also well known. Candles may be manufactured by pouring molten wax into mold, and allowing the wax to solidify. Alternatively, candles are manufactured by repeatedly dipping the wick into-molten wax and allowing the wax to harden onto the wick or the previous build-up of wax, to create a layered effect of wax around a central wick.

Despite the long history of candle manufacture and use, the nature of candle wax continues to pose difficulties in the shipping and storing of candles. Candle wax softens, and even melts, at temperatures that are commonly reached during the routine candle shipping and storing process. Even if the candles do not melt, the softened candles may bend, and then reharden in their bent condition. Taper candles are particularly prone to bending because their elongate shape provides little rigidity transverse to the candle axis. A melted candle loses its shape completely. Votive candles are less likely to bend than taper candles because of their thicker cross section. However, votive candles are commonly manufactured of wax with a relatively low melting point, so that the votive candles at least partially melt between the time of their manufacture and the time that they are delivered to their eventual users. Either bent or melted candles result in spoilage of the candles, entailing reduced manufacturer profits and/or higher consumer costs.

One method of reducing candle spoilage due to heat effects is to ship and store the candles in a temperature controlled environment. However, this is unduly expensive and is not done in practice. Another approach would be to manufacture candles out of wax that has a higher melting temperature than current candles have. However, this may be costly or may have adverse effects on the burning characteristics of the candles. Instead, a certain amount of candle spoilage has been tolerated as a cost of the candle-making business. Thus, a need exists to reduce candle deformation spoilage that uses current candle designs and is not prohibitively expensive.

SUMMARY OF THE INVENTION

The present invention provides for a device and method of packing and storing candles that reduces heat-induced bending and melting, and hence reduces the spoilage that is common during candle transit and storage.

The candles are shipped and stored in individual storage compartments that approximate the shape of the candles. If the ambient temperature reaches the candle wax melting point and the candles start to melt, the melted candle wax will remain in the storage compartments, although as a liquid instead of a solid. Eventually, the ambient temperature will decrease, causing the candle wax to resolidify. Since the candle compartments are essentially the same shape as the candles, the candles will have the same shape after they have resolidified as they had before melting. Therefore, no actual permanent damage has been done to the candles.

The candle storage compartments essentially act as molds, similar to the molds in which the candles were initially manufactured. When the candles melt, the molten wax is in the same condition as when the molten wax is initially placed in the manufacturing mold; when the wax cools, the candle takes the same shape as the initial mold.

Depending on the ambient temperature to which the candles are subjected, it may not be necessary for the storage compartments to be identical in shape to the initial mold, because in practice the temperatures rarely achieve levels high enough to completely melt all of the wax in a candle. Instead, the candle wax only softens. Gravitational force (or, possibly, inertial force if the candle is transported while the wax is softened) on the candle causes the candle to compress and, if the candle is unconfined, to spread out, i.e., for the diameter of the candle to increase. Pressure on the candle increases towards the candle base, because more candle wax mass then presses down. Often, only the lower portion of a candle needs to be contained in a compartment to prevent the candle from deforming. Thus, the compartments need only partially approximate the shape of the candles which they are designed to store. Different styles of candles may benefit from somewhat different compartment configurations. For example, taper candles require a storage configuration that prevents the candles from bending, while votive candles do not need that accommodation.

For ease of handling, shipping, and storing, an array of storage compartments may be interconnected to form a candle storage tray. The tray, and thus a group of candles, may be handled as a single unit. Preferably, candles are inserted into the tray soon after they are manufactured, and are not removed from the tray until they are delivered to the end user. The tray may be inexpensively manufactured from blow-molded plastic, so that it may be used disposably. Of course, other suitably heat resistant materials such as metal foil may also produce good results.

For taper candles, in particular, it is desirable to pack a plurality of trays into a storage container such as a basket, with the basket sized to provide lateral support to the trays, and further reduce to the possibility of the candles bending. While many types of boxes could be used to support a plurality of trays, a basket (such as a conventional wicker basket) is resilient so that the trays will snugly fit into a basket that is properly dimensioned. Baskets also have an aesthetic appearance that is particularly well suited to the religious and decorative functions that taper candles often perform.

DETAILED DESCRIPTION OF THE INVENTION

Figure 1:
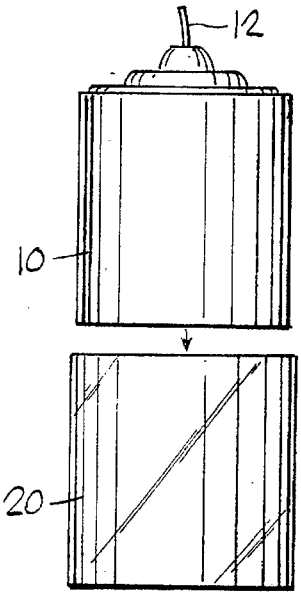
FIG. 1 shows a side elevational view of a candle and a storage compartment according to the present invention, before the candle has been inserted into the storage compartment.
Figure 1A:
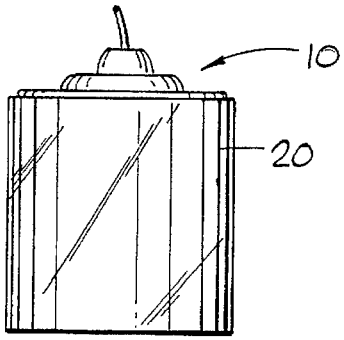
FIG. 1A shows the view of FIG. 1 after the candle has been inserted into the storage compartment.

With reference to FIG. 1, a storage compartment 20 may receive a candle 10 to prevent heat-induced damage to the candle 10 when it is shipped and stored. The candle 10 has a wick 12 that defines the top of the candle 10. The candle 10 is depicted to be a "votive" candle. Votive candles are generally cylindrical in shape, with a length (the distance from the base of the candle to the wick 12) that is somewhat close to the diameter of the candle. However, the candle 10 could be any style of candle, with an appropriately modified storage compartment 12.

Figure 1B:
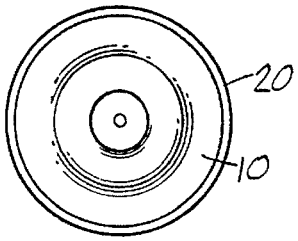
FIG. 1B shows a top view of FIG. 1A.

The storage compartment 20 is of substantially the same shape as the candle 10. The diameter of the storage compartment 20 is preferably slightly smaller than that of the candle 10, so that the candle 10 will form a compression fit with the compartment 20 when it is slid therein (see FIG. 1B). The height of the compartment 20 is close to the height of the candle 10, but is somewhat less than the height of the candle 10 so that a portion of the candle 10 extends above the compartment and may be grasped to insert or remove the candle 10 from the compartment 20.

The candle 10 may melt between the time when the candle 10 is manufactured and the time when the candle 10 is delivered to an end user. The candle 10 may fully melt, i.e., all of the wax may become molten, or, more likely, only some of the candle wax may melt. In either event, the candle 10 will presumably have an opportunity to cool before it is delivered to its end user, since temperatures hot enough to melt the wax are not common in places such as stores, Churches, or dwellings where an end user would take possession of the candle.

As the candle 10 cools, the wax resolidifies, and takes the shape of the compartment 20, which essentially acts as a mold. Since the shape of the compartment 20 is similar to that of the candle 10, the resoldified candle 10 will have essentially the same shape as it did before it melted. The degree of similarity between the pre-melted candle 10 and the resolidified candle 10 is governed by the similarity of the compartment and the candle 10. The compartment could have exactly the same shape as the mold in which the candle was initially manufactured, and that is one embodiment of the present invention. In that case, the resolidified candle would have exactly the same shape as the pre-melted candle. The compartment 20 has essentially the same shape as the candle 10 at the base of the candle 10 extending up to a selected height of the candle 10. The compartment 20 does not extend completely to the top of the candle, so that a potion of the candle 10 extends out of the compartment 20 and may be grasped.

Figure 2:
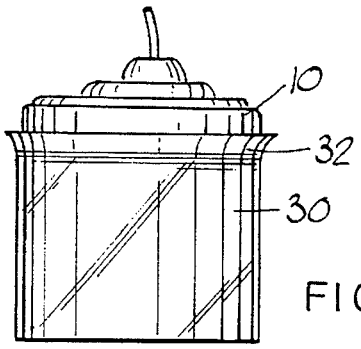
FIG. 2 shows a side elevational view similar to FIG. 1A with an alternate storage compartment.

An alternate embodiment of the invention is depicted in FIG. 2, with the candle 10 fitting into compartment 30. As with the compartment 20, the compartment 30 is not as tall as the candle 30, so that a portion of the candle 30 extends out of the compartment 30. The upper portion of the compartment 30 widens out into a ridge 32, so that any candle wax that melts in the portion of the candle 10 above the ridge 32 will collect in the reservoir defined by the ridge 32. The shape of the compartment 30 takes advantage of the fact that, depending on the ambient temperature in which the candle 10 will be exposed, only a lower section of the candle 10 will deform. This is because the candle wax often does not completely melt; instead, it merely softens. The greater pressure on the lower portion of the candle 10, caused by the portion of the wax above the lower portion, causes the lower portion to deform. The lower portion of the compartment 30 prevents the deformation of the lower portion of the candle 10. The upper portion of the candle 10 will usually not deform, because there is less pressure on the upper portion. Still, the reservoir prevents spillage of candle wax in the event that the upper section of the candle 10 does melt.

Figure 3:
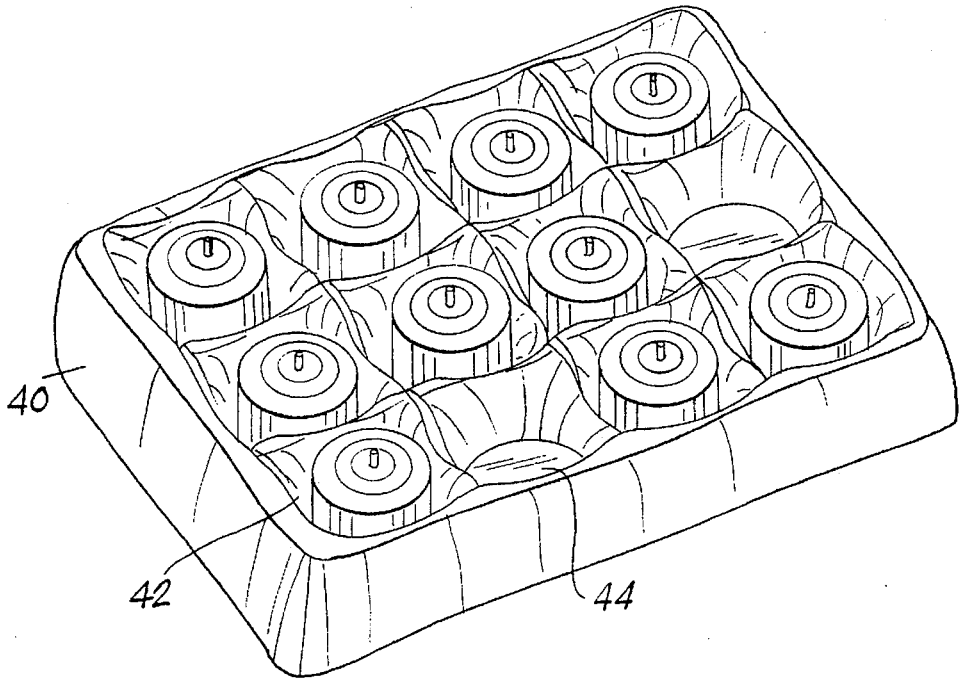
FIG. 3 shows a perspective view of a tray formed of an array of storage compartments similar to the individual storage compartment of FIG. 1B.

With reference to FIG. 3, a third embodiment of the present invention is a tray 40 formed of connected candle storage compartments, such as compartments 42, 44, that are similar to the compartment 30. Each individual compartment in tray 40 has a lower section that is the approximate diameter of the candle 10, and a flared upper section that extends away from the candle 10. The lower compartments are preferably slightly smaller than the candle 10 diameter, so that an interference fit is created. The upper sections of adjacent compartments are connected to one another, and define the boundaries between the individual compartments. The tray 40 preferably contains 12 individual compartments, arranged in three rows and four columns. However, it should be apparent that the tray 40 could easily have either more or fewer individual compartments, and the compartments could be arranged in different configurations. The exterior edges of the tray 40 are formed by the individual compartment edges. However, the compartment edges that form the exterior of the tray 40 extend above the candles, so that the candles are enclosed by the tray 40. This protects the candles from damage and allows the tray 40 to be stacked onto similar trays.

The tray 40 serves the dual functions of protecting the candles from heat damage and providing a convenient transportation and storage unit. Candles may be inserted into the tray 40 after the candles are manufactured, and delivered to candle retailers or end users without removing the candles from the tray 40.

The compartments 20 and 30 and the tray 40 are preferably made of plastic, which may be blow-molded to the desired shape, although materials other than plastic, such as metal foil, may be used as alternate designs. The thickness of the plastic should be great enough to give the compartments 20, 30 or tray 40 some rigidity when no candles are contained therein, but thin enough to allow for some expansion in the diameter of the candle receiving section when a candle is inserted, so that a snug fit will result. The plastic (or other material) should be selected so that it will not melt or deform at the temperatures to which the candles are expected to be exposed during storage or transit.

Proper orientation of the candles stored and transported in compartments 20, 30 and the tray 40 must be maintained, with the Candle wicks pointing up. Otherwise, the candle wax, directed by gravity, may run out of the compartments 20, 30 or the tray 40.

Figure 4:
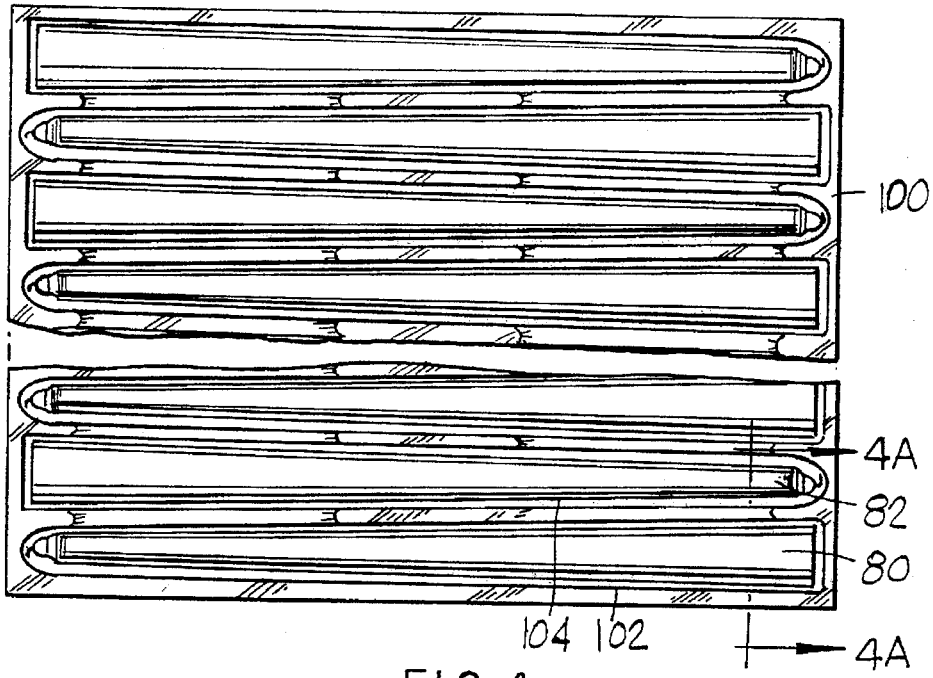
FIG. 4 shows a top view of a tray formed of individual storage compartments adapted to store taper candles.

FIG. 4 shows a tray 100 adapted to store taper candles, such as candles 80 and 82. The tray consists of a row of compartments such as 102 and 104, each compartment adapted to receive one taper candle. The compartments 102, 104 have the approximate shape of the taper candles 80, 82 so that the taper candles 80, 82 fit snugly into the compartments 102, 104. Spoilage of taper candles most commonly occurs when the candles bend along their axes, after they are softened by the hot temperatures in which they are often stored and transported. The tray 100 provides support that prevents the candles from bending. It should be apparent that it is impossible for the candles in the tray 100 to bend unless the tray 100 itself were also to bend. The tray 100 is constructed out of suitably rigid material to prevent it from bending under normal conditions.

The compartments 102, 104 are aligned in a row with candles 80, 82 pointing in opposite directions. That is, the compartment 102 receives the relatively broad bottom of the candle 80 at one end, and the compartment 104 receives the candle 82 with the relatively narrow top of the candle 82 at its corresponding end. This arrangement most efficiently uses the volume of the tray 100.

Figure 4A:
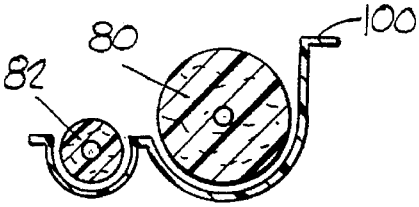
FIG. 4A shows a view taken along the line 4A—4A in FIG. 4.

The tray 100 supports the candles along the entire length of their sides, to prevent the possibility of the candles flexing. However, the candle sides need not be supported around the entire circumference of the candles. The tray 100 is in contact with approximately one half of each candle stored therein, which allows ample surface area to place and remove the candles (see FIG. 4A).

Figure 5:
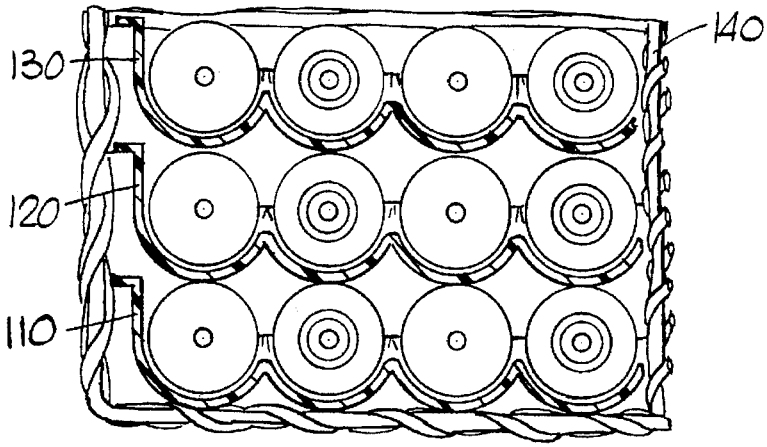
FIG. 5 shows a side view of a basket containing several trays of the type depicted in FIG. 4, with a portion of the basket cut away.

With reference to FIG. 5, the rigidity of each tray may be increased by stacking several trays 110, 120, 130 in a storage compartment such as a basket 140. The basket 140 is dimensioned so that each tray 110, 120, 130 is firmly supported at its edges. A wicker basket 140 is preferred, because its resilient nature allows for the trays 110, 120, 130 to be snugly positioned in the basket. The stacking of the trays 110, 120, 130 increases the effective rigidity of the trays by physically connecting the trays with each other as well as with the basket 140. For one of the trays 110, 120, 130 to bend, the entire assembly would have to bend, which is unlikely to occur. The basket 140 also allows for more candles to be transported as a unit, and provides an aesthetically pleasing storage container, which is well adapted to the religious and decorative functions for which taper candles are often used.

What is claimed is:

1. A tray for storing a plurality of candles, comprising:

an array of compartments, each compartment having a base and a sidewall extending upwards form the base so as to define a volume for at least partially enclosing a candle, at least a portion of the sidewall of each of the compartments being connected to the sidewall of another of the compartments;

each of the sidewall including two sections, the first section extending perpendicularly upwards form the base, the second section being vertically above the first section and contiguous therewith, the second section widening out from and extending above the first section;

the compartments being arranged in evenly spaced rows and columns, so that the sidewall of each compartment contains at least one portion that faces another compartment in the same row and another potion that faces another compartment in the same column;

wherein the second section of each sidewall has a varying height, with the height being relatively lower at the sidewall edge portions that face a compartment in the same row and that face a compartment in the same column, and the sidewall edge portions being relatively higher at the portions that do not face another compartment in the same row or column.

2. The tray of claim 1, wherein there are three rows and four columns.

* * * * *